United States Patent [19]

Maxim

[11] Patent Number: 4,680,021

[45] Date of Patent: Jul. 14, 1987

[54] MULTI-ACTION TOY VEHICLE

[76] Inventor: John Maxim, 25 Mill Valley La., North Stamford, Conn. 06903

[21] Appl. No.: 527,624

[22] Filed: Aug. 29, 1983

[51] Int. Cl.[4] ..... A63H 17/00

[52] U.S. Cl. ..... 446/457; 446/437

[58] Field of Search ..... 446/457, 464, 463, 462, 446/461, 459, 465, 469, 470, 437, 440, 454, 455, 456, 431

[56] References Cited

U.S. PATENT DOCUMENTS

| | | | |
|---|---|---|---|
| 1,682,764 | 9/1928 | Mohr | 446/457 X |
| 3,698,129 | 10/1972 | Lemelson | 446/462 |
| 4,363,187 | 12/1982 | Shinohara | 446/437 |
| 4,438,589 | 3/1984 | Matsushiro | 446/462 |
| 4,467,557 | 8/1984 | Kuna et al. | 446/463 |

*Primary Examiner*—Mickey Yu

*Attorney, Agent, or Firm*—Blum & Kaplan

[57] ABSTRACT

A multi-action toy vehicle which includes a chassis having wheels coupled thereto. A changing mechanism supported on the chassis changes the center of gravity of the vehicle. A control lever operatively coupled to the changing mechanism acts to control and set the changing mechanism in desired positions. In a first embodiment, the changing mechanism inlcudes weights whose positions can be changed by the control lever. In a second embodiment, the changing mechanism includes a sliding platform to which the rear wheels are coupled so that the wheel base of the toy vehicle can be adjusted.

10 Claims, 36 Drawing Figures

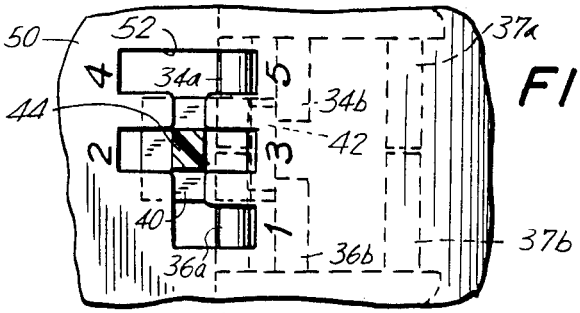
FIG. 6
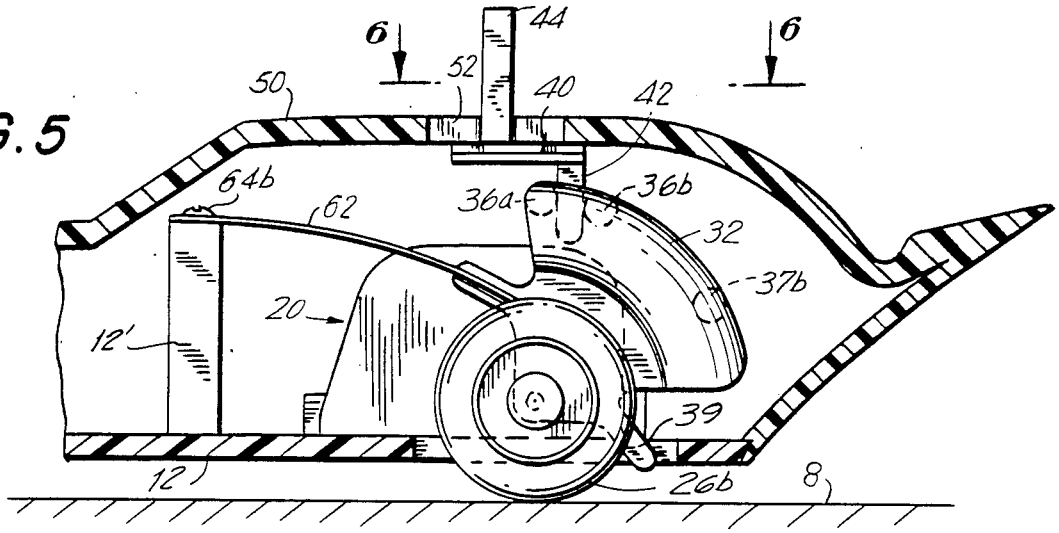
FIG. 5
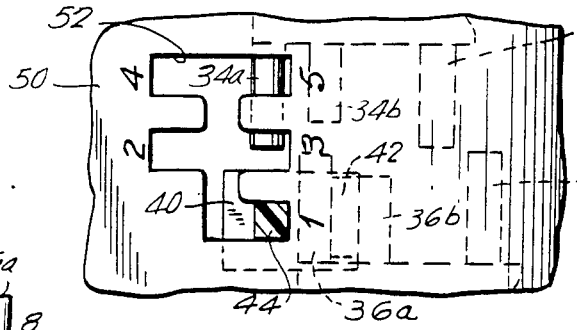
FIG. 8
FIG. 9
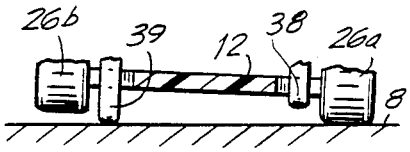
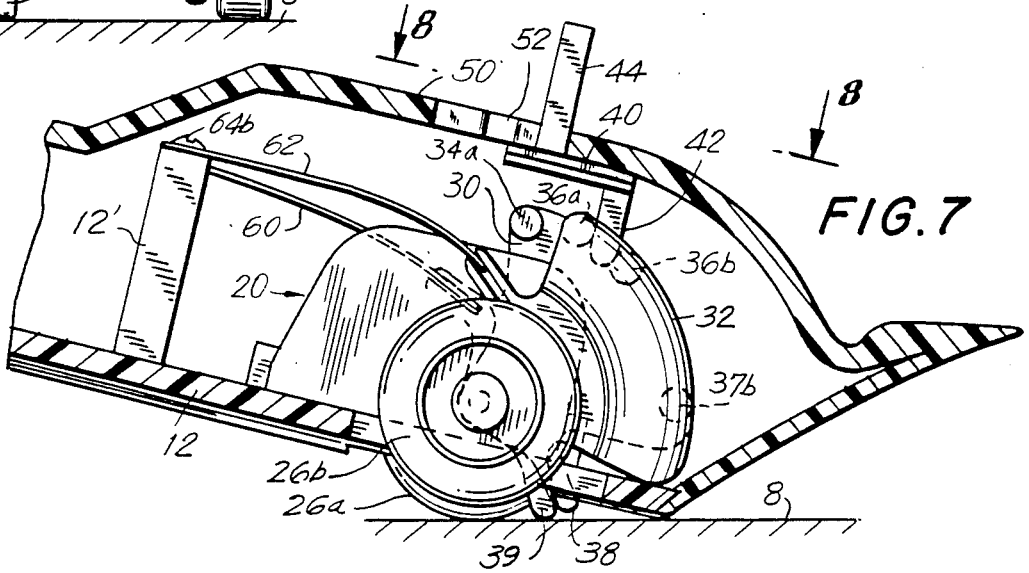
FIG. 7

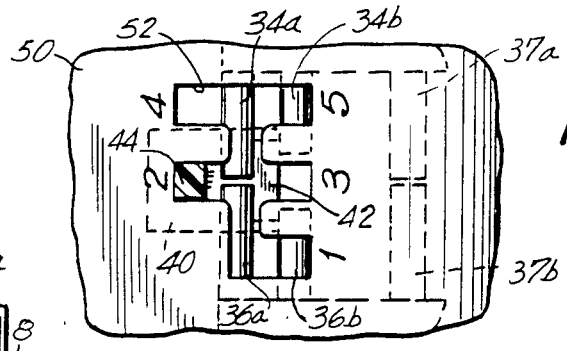
FIG. 11
FIG. 12
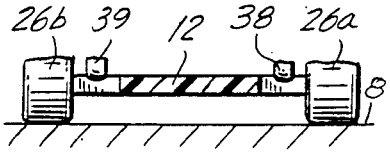
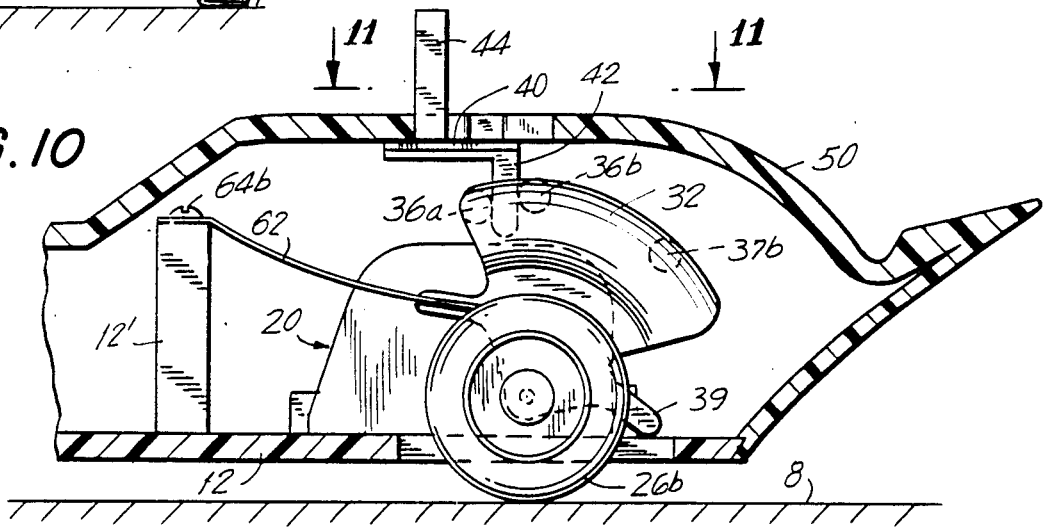
FIG. 10
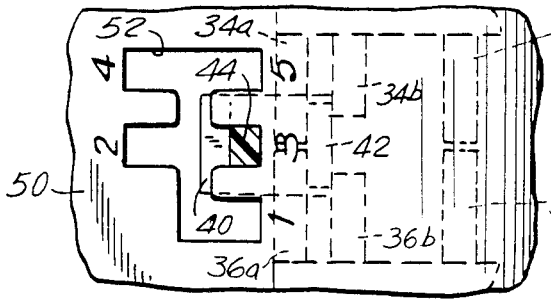
FIG. 14
FIG. 15
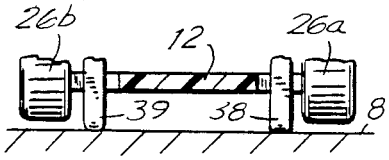
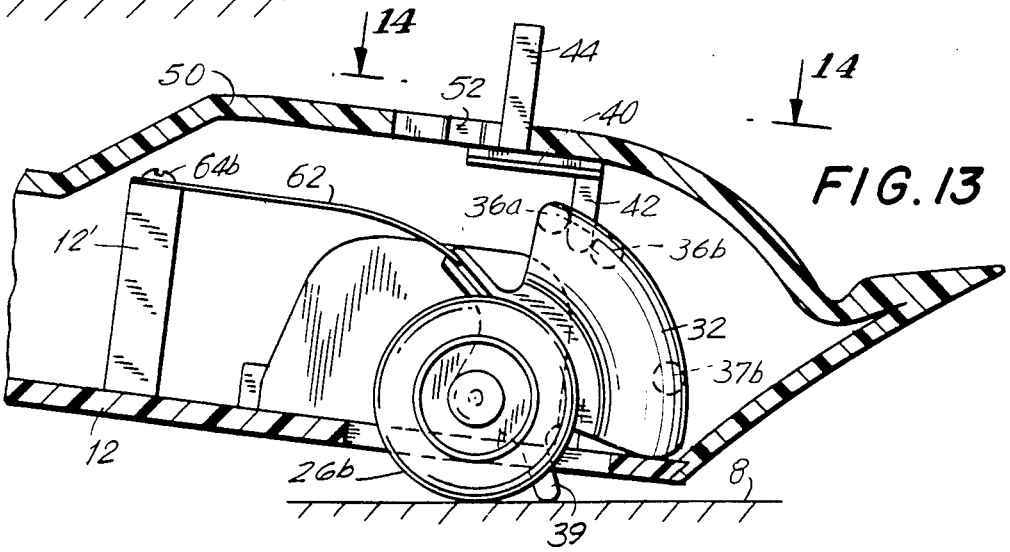
FIG. 13

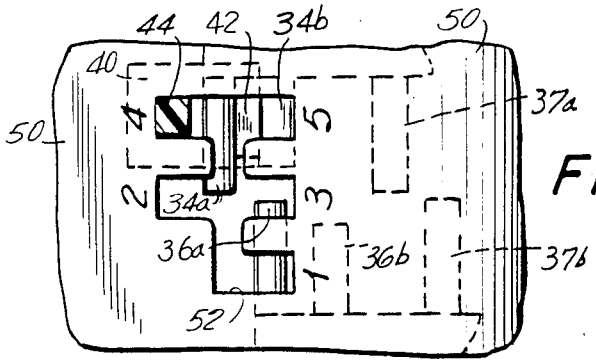
FIG. 17
FIG. 18
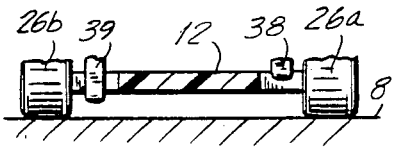
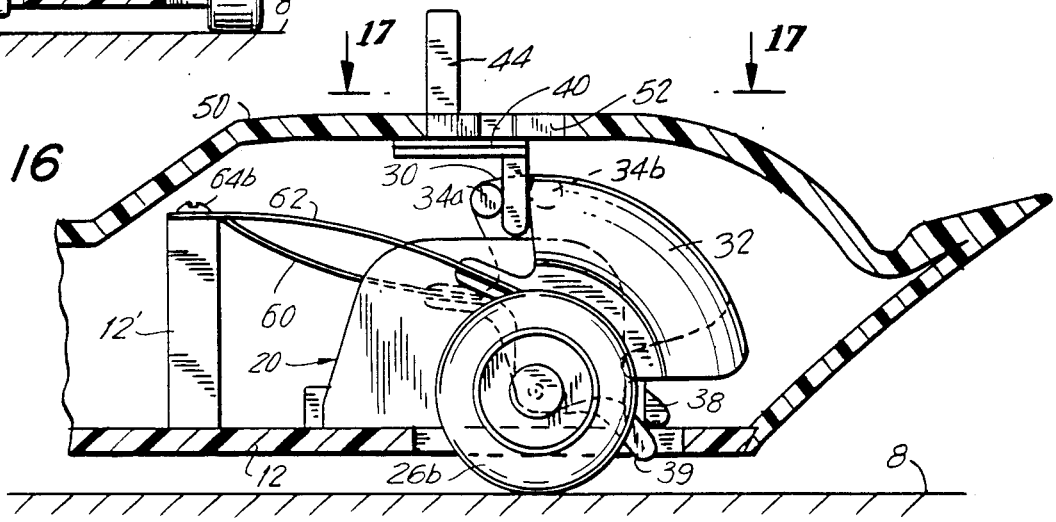
FIG. 16
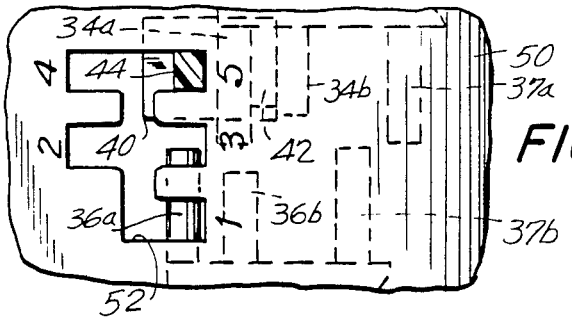
FIG. 20
FIG. 21
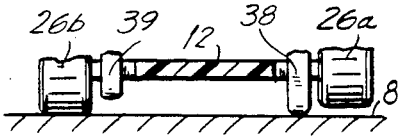
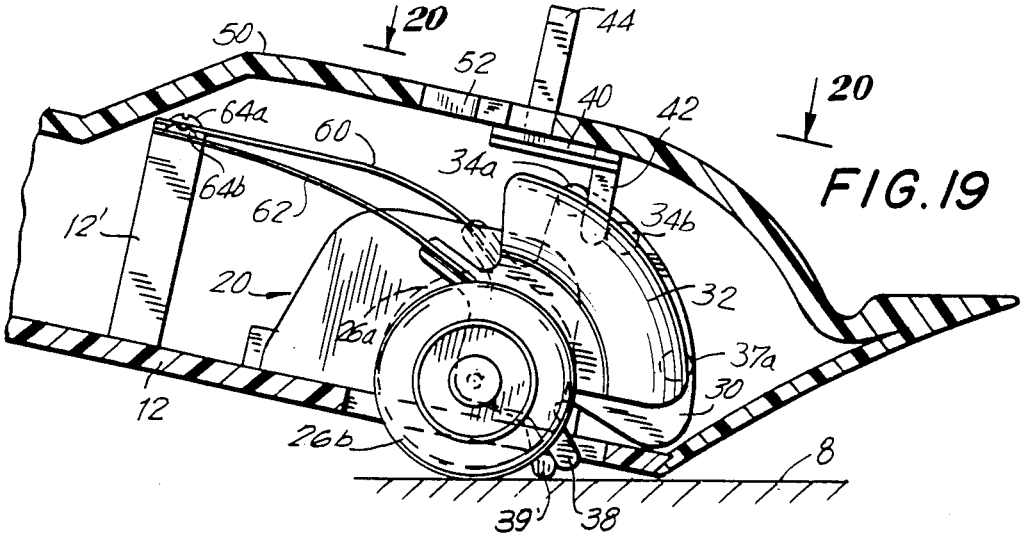
FIG. 19

FIG. 22
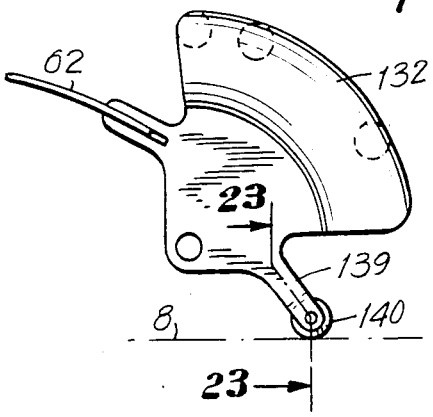
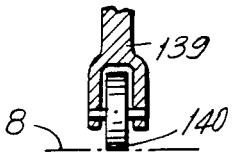
FIG. 23
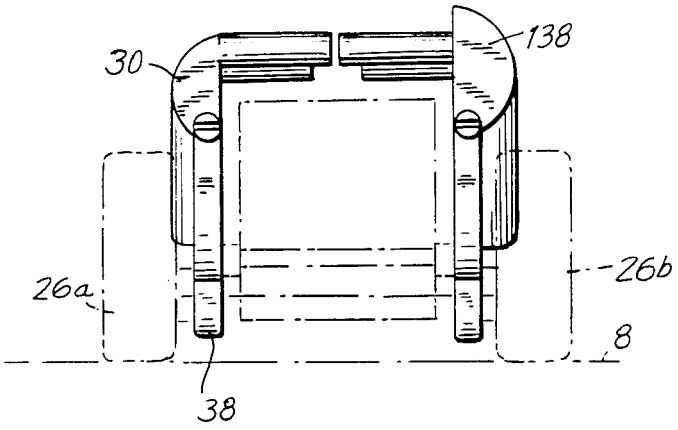
FIG. 24
FIG. 25
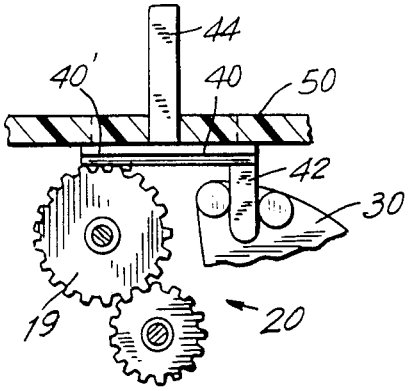

MULTI-ACTION TOY VEHICLE

BACKGROUND OF THE INVENTION

The present invention is directed to a toy vehicle and, in particular, to a toy vehicle whose physical behavior and operating characteristics can be selectively altered by a child playing with the toy vehicle, preferably by moving a simulated gear-shift lever, which permits the toy vehicle to perform multiple actions depending on the positon of the operative components as selected by the shift lever.

Toy vehicles such as toy automobiles which simulate the appearance and operation of real automobiles and which are capable of being self-propelled by an internal motor or the like have become popular with children of all ages. One such type of toy vehicle includes what has been commonly known as a pull-back motor. In such vehicles, the rear wheels of the toy vehicle are coupled to a motor which includes a spring which is tightened as the rear wheels are rolled backwards along a surface. In such fasion, the spring becomes tightened so that when the vehicle is released, the spring will relax and transfer its energy via torque to the rear wheels causing them to rotate in a forward direction to propel the toy vehicle in a forward direction. Mechanisms of the type under discussion are disclosed, for example, in U.S. Pat. Nos. 4,077,156 and 3,798,831. Other than being capable of changing the acceleration and speed of such toy vehicles depending upon the amount of energy stored in the spring, only one type of action, namely forward action on all four wheels is possible.

It would be extremely desirable if a toy vehicle having a motor which permits self-propulsion could be developed to perform multiple actions such as wheel stands, turning, spinning-out and the like. It would be even more desirble if such a toy vehicle could perform such multiple acions as controlled by a lever which simulates a real gear-shift lever in an automobile having a manual transmission whereby the placing of the gear-shift lever in a desired gear position in the toy vehicle results in different types of action to be performed by the toy vehicle. The present invention provides a multi-action toy vehicle which meets the desires expressed above.

SUMMARY OF THE INVENTION

Generally speaking, in accordance with the instant invention, a toy vehicle is provided which includes a chassis having wheels rotatably supported thereon to permit the toy vehicle to roll on a surface. A changing mechanism is provided for selectively changing the operating characteristics of the toy vehicle. A lever actuates the changing mechanism in response to manual actuation thereof in order to change the manner in which the toy vehicle will ride on a surface.

In a first preferred embodiment, weights are movably supported on the chasis. The lever is operatively coupled to the weights and, in response to manual actuation thereof, selectively positions the weights with respect to the chassis to selectively change the center of gravity of the toy vehicle. In a second embodiment, the lever is manually actuatable to change the distance between the front and rear wheels thereby changing the center of gravity of the toy vehicle.

Projections may be provided on the chassis which selectively contact the ground in various operating modes such as when the vehicle is performing a wheel stand.

The toy vehicle may include an energy storing mechanism such as a pull-back or wind-up motor to permit the toy vehicle to be self propelled.

Accordingly, it is an object of the present invention to provide a multi-action toy vehicle.

Another object of the present invention is to provide a multi-action toy vehicle in which a simulated gear-shift lever is manually actuatable to change the operating characteristics and physical behavior of the toy vehicle.

A further object of the present invention is to provide a toy vehicle whose operating characteristics such as the center of gravity or wheel base, can be altered in response to manual actuation of a lever to provide the vehicle with multiple actions.

A still further object of the present invention is to provide a toy vehicle capable of multiple actions which has a greatly enhanced play value.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5 is a sectional side elevational view similar to FIG. 4 but taken through a different portion of the toy vehicle, with the lever in a neutral position;

FIG. 6 is a sectional view taken along lines 6—6 of FIG. 5;

FIG. 7 is partial side elevational view of the toy vehicle depicted in FIG. 1 performing a wheel stand with the lever in the first gear position;

FIG. 8 is a sectional view taken along line 8—8 of FIG. 7;

FIG. 9 is a partial elevational view of the rear wheels of the toy vehicle depicted in FIG. 7;

FIGS. 10, 11 and 12 are views similar to FIGS. 7, 8 and 9 but depict the toy vehicle in the second gear position;

FIGS. 13, 14 and 15 are views similar to FIGS. 7, 8 and 9 but depict the toy vehicle in the third gear position;

FIGS. 16, 17 and 18 are views similar to FIGS. 7, 8 and 9 but depict the vehicle in the fourth gear position;

FIGS. 19, 20 and 21 are views similar to FIGS. 7, 8 and 9 but depict the toy vehicle in the fifth gear position;

FIG. 22 is an elevational view of an alternative construction of the pivotable weight in the toy vehicle of the present invention;

FIG. 23 is an enlarged sectional view taken along lines 23—23 of FIG. 22;

FIG. 24 is a partial front sectional elevational view depicting an alternative embodiment of the pivotable weights of the toy vehicle of the present invention;

FIG. 25 is a partial elevational view of several gears in the motor and lever constructed in accordance with an alternative embodiment of the present invention;

DESCRIPTION OF THE PREFERRED EMBODIMENTS

Figure 1:
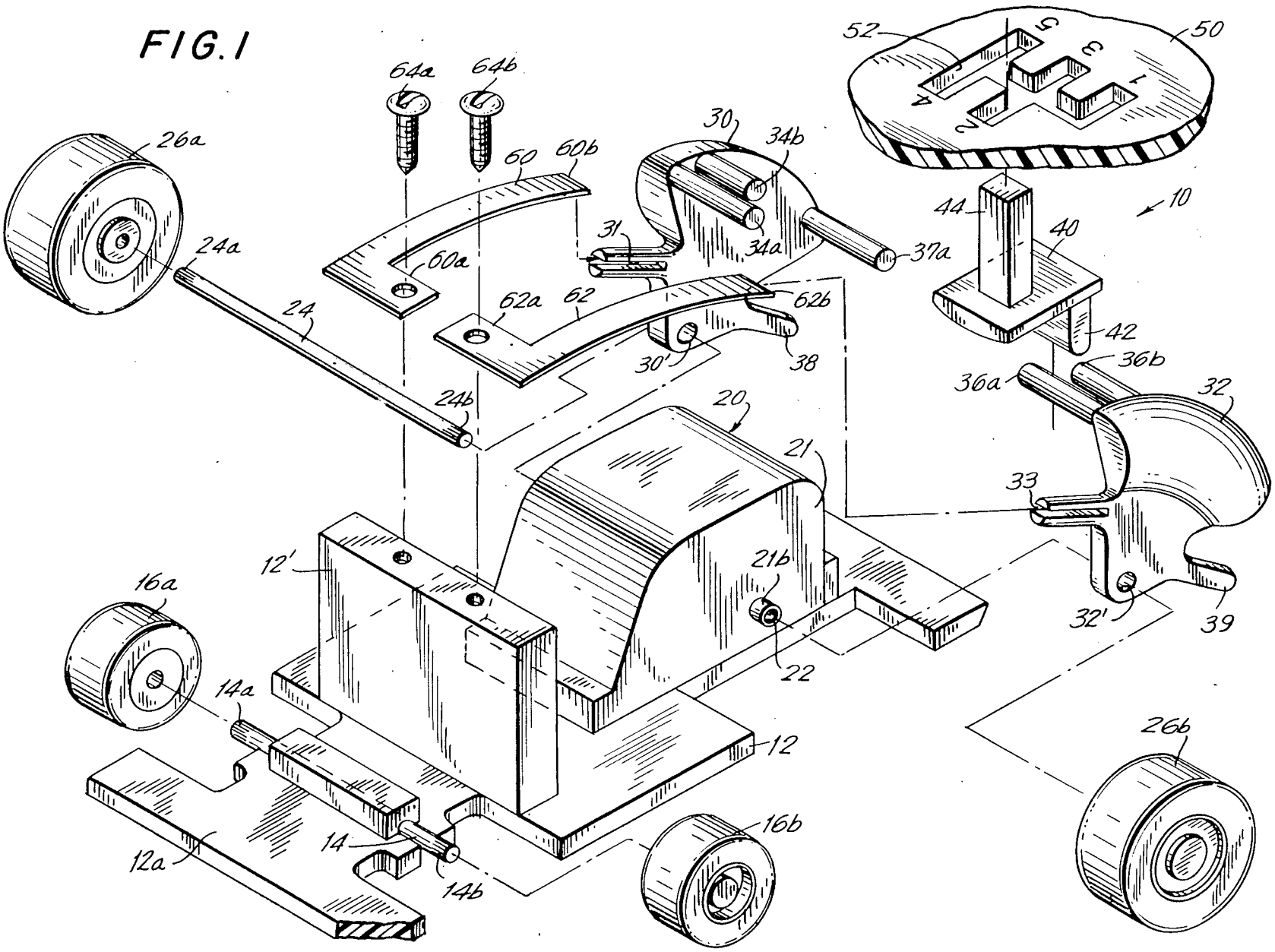
FIG. 1 is an exploded perspective view of a multi-action toy vehicle constructed in accordance with a preferred embodiment of the present invention, with only a portion of the toy vehicle body being depicted.
Figure 2:
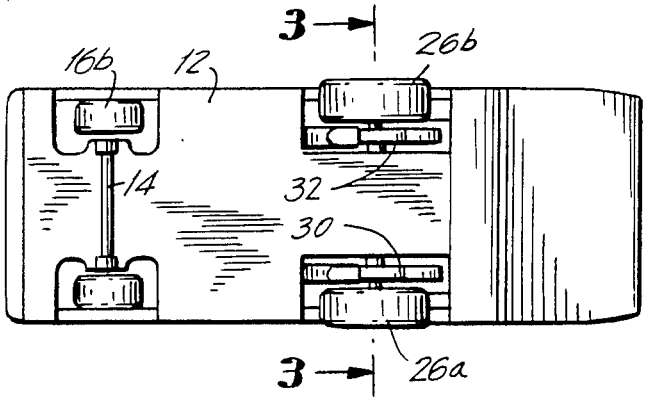
FIG. 2 is a bottom plan view of the toy vehicle depicted in FIG. 1, as constructed.
Figure 3:
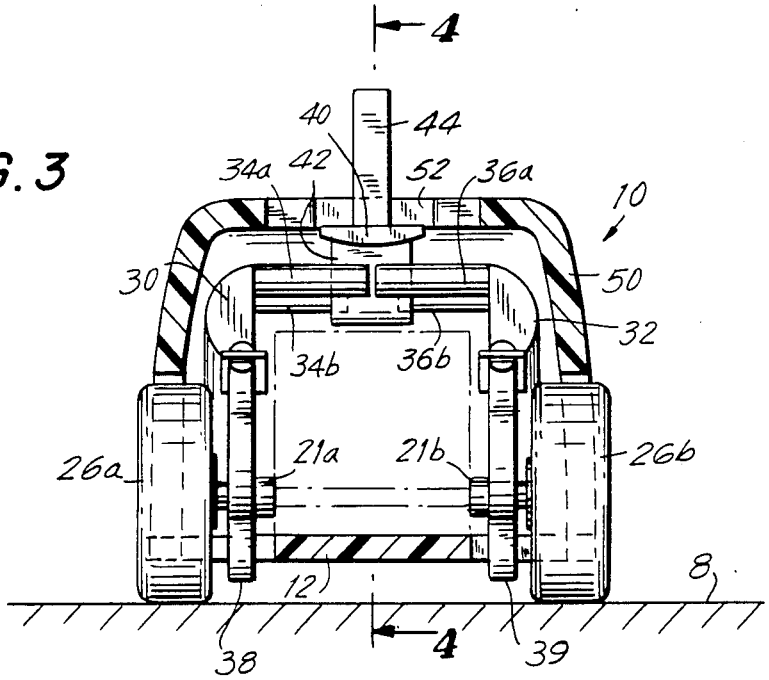
FIG. 3 is an enlarged sectional view taken along line 3—3 of FIG. 2.

Reference is first made fo FIGS. 1 through 3 which depict a toy vbehicle, generally indicated at 10, constructed in accordance with a preferred first embodiment of the present invention. Toy vehicle 10 includes a toy vehicle frame or chassis 12 on which the several components of toy vehicle 10 are disposed. A front axle 14 is rotatably supported on front end 12*a* of chassis 12. A pair of front wheels 16*a* and 16*b* are secured to opposite ends 14*a* and 14*b*, respectively, of axle 14 so as to be rotatable therewith.

An energy storing mechanism such as a motor 20 is secured to chassis 12. Motor 20 includes a through hole 22 in which a rear axle 24 is inserted. A pair of rear wheels 26*a* and 26*b* are secured to ends 24*a* and 24*b*, respectively, of axle 24 so as to be rotatable therewith.

Motor 20 may be a pull-back motor of the type disclosed in U.S. Pat. Nos. 4,077,156 and 3,798,831 in which a spring is tightened by rolling the rear wheels in a reverse direction over a surface to store energy, which energy, when the vehicle is released, will cause the vehicle to be projected forward. Accordingly, rear axle 24 will be appropriately linked to motor 20 so that torque created thereby can be applied to rear axle 24 to cause it to rotate in a forward direction. it is noted that other types of energy storing mechanisms may be utilized, such as a conventional wind-up motor or the like. However, it is also recognized that the present invention may operate under manual proplusion although a selfpropelled toy vehicle is preferable.

First and second weights 30 and 32 are pivotably supported intermediate rear wheels 26*a* and 26*b*, respectively, and motor 20. In this regard, hosuing 21 of energy storing mechanism 20 may include cylindrical open projections 21*a* and 21*b* which respectively pivotably support weights 30 and 32 through respective openings 30′ and 32′. As will be described below in detail, weights 30 and 32 are pivotable to selected positions to alter the center of gravity of toy vehicle 10 in order to provide vehicle 10 with different operating conditions and physical behavior dependent upon the position of weights 30 and 32.

A simulated gear-shift lever or control know 40 is provided for selectively positioning weights 30 and 32. Control knob 40 includes a downwardly extending projection 42 which is captured between pegs 34*a* and 34*b* of weight 30 and pegs 36*a* and 36*b* of weight 32. Control knob 40 also includes an upwardly extending rod or lever 44. A toy vehicle body 50 is appropriately coupled to chassis 12. Body 50 includes a cut out pattern or slot 52 in the form of a gear shift pattern and is appropriately marked with indicia such as the numbers 1 through 5 as depicted to denote the plurality of positions and in order to further simulate a gear shift pattern of an acutal automobile. Shift lever 44 extends through slot 52 and is movable between the positions indicated.

First and second leaf springs 60 and 62 each have a first end 60*a* and 62*a*, respectively, which is secured to vertical block 12′ on chassis 12 by means of screws 64*a* and 64*b*. Opposite ends 60*b* and 62*b* of leaf springs 60 and 62 extend into slots 31 and 33 formed in weights 30 and 32 respectively. Leaf springs 60 and 62 apply a force to weights 30 and 32 so that they remain in a neutral position, as described below in detail, and which also return weights 30 and 32 to their neutral position when shift lever 44 is returned to its neutral position after being moved from one of the five gear positions. Weights 30 and 32 include additional extending rods 37*a* and 37*b*, respectively, which aid in stabilizing weights 30 and 32 and to insure proper pivoting thereof.

Weights 30 and 32 include projections 38 and 39 respectively which will contact the surface on which vehicle 10 is riding under certain operating conditions when shift lever 44 is positioned in certain of the gear positions, as will also be described below in detail.

Figure 4:
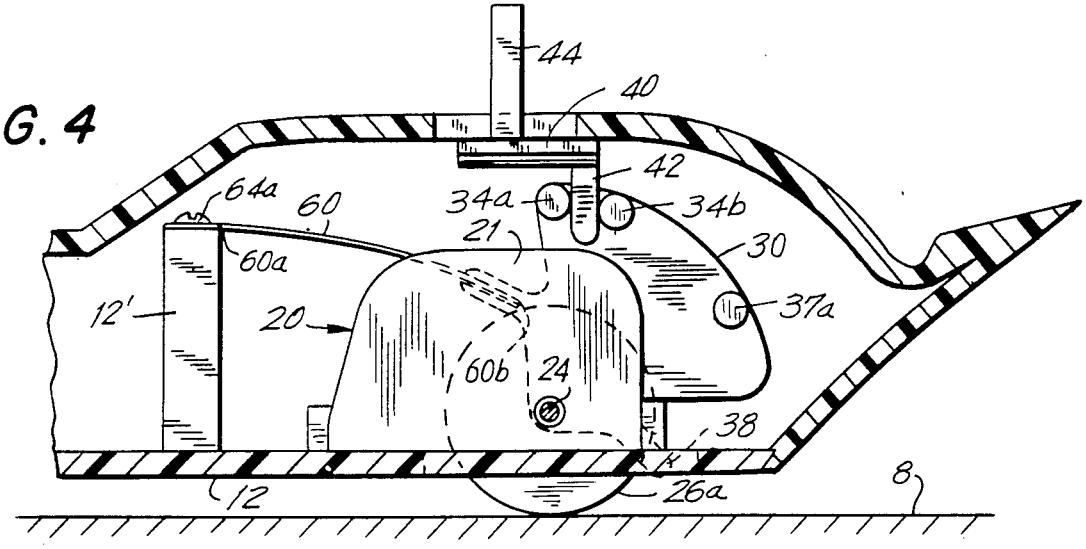
FIG. 4 is a sectional view taken along line 4—4 of FIG. 3.

Reference is now made additionally to FIGS. 3 through 21, in order to describe the use and operation of toy vehicle 10. FIGS. 3 through 5 depict toy vehicle 10 when shift lever 44 is in a neutral position, that is when shift lever 44 is not set in one of the numbered gear slots as best depicted in FIG. 6. In the neutral position, weights 30 and 32 remain in their central, neutral position as positioned by leaf springs 60 and 62. Projections 38 and 39 on weights 30 and 32 do not substantially extend through chassis 12 and will not contact surface 8 on which toy vehicle 10 is riding even if toy vehicle 10 performs a wheel stand where front end 12*a* of chassis 12 is lifted into the air. The center of gravity of toy vehicle 10 will be in a normal position such that, after torque is applied by motor 20 to rear wheels 26*a* and 26*b*, as toy vehicle 10 moves forward, the vehicle will either run straight on all four wheels or will perform a wheel stand if a sufficient amount of rotational energy is supplied to the rear wheels to cause the front of the toy vehicle to lift up.

When shift lever 44 is moved into the first gear position as depicted in FIGS. 7 through 9, toy vehicle 10 will exhibit a different physical behavior as described hereinafter. It is noted that sufficient friction is provided between slot 52 and shift lever 44 so that shift lever 44 is held in the first gear position until manually forced back to the neutral position. The same is also true for gear positions 2 through 5 where shift lever 44 will be held in those gear positions until manually forced back to the neutral position.

In the first gear position, weight 32 on the left side of toy vehicle 10 is pivoted and locked in a rearward position. Projection 39 protrudes through chassis 12 as best depicted in FIGS. 7 and 9. Since weight 32 is pivoted, the center of gravity of toy vehicle 10 will be shifted back to 50% of its maximum rear position. After motor 20 is energized and toy vehicle 10 is released on surface 8 to ride in a forward direction, the front wheels of the vehicle will lift off the ground causing the toy vehicle to perform a wheel stand and toy vehicle 10 will turn to the left as projection 39 contacts surface 8.

Toy vehicle 10 with shift lever 44 in the second gear position is depicted in FIGS. 10 through 12. In the second gear position, projection 42 contacts both pegs 34*a* of weight 30 and 36*a* of weight 32 causing weights 30 and 32 to pivot and remove in a forward direction. The center of gravity of toy vehicle 10 is moved forward to 100% of its maximum position. Because the center of gravity is moved forward sufficiently, the toy vehicle will run straight when driven by motor 20 and will not perform a wheel stand.

FIGS. 13 through 15 depict toy vehicle 10 when shift lever 44 is moved to the third gear position. In third gear, both weights 30 and 32 are pivoted in the rearward direction since projection 42 on control knob 40 contacts both pegs 34*b* on weight 30 and 36*b* on weight 32. Both projections 38 and 39 are lowered through chassis 12. The center of gravity of toy vehicle 10 is moved to 100% of its maximum to the rear of the toy vehicle.

As motor 20 causes toy vehicle 10 to move in the forward direction, the front wheels of the toy vehicle will readily lift off the ground and the vehicle will turn right or left depending upon the running surface friction characteristics. In addition, projections 38 and 39 will contact the ground as toy vehicle 10 performs wheel stands to cause different physical behavior and operating characteristics of the toy vehicle.

In the fourth gear position as depicted in FIGS. 16 through 18, right weight 30 is pivoted forward. The center of gravity of toy vehicle 10 will be moved forward 50% of its maximum since only one of the weights is pivoted forward. As motor 20 releases its stored energy to the rear wheels, toy vehicle 10 will either ride forward wiall all four wheels on the ground or the vehicle will perform a wheel stand.

FIGS. 19 through 21 depict toy vehicle 10 when shift lever 44 is in the fifth gear position. In this position, right weight 30 is pivoted to the rear lowering projection 39 thereof below chassis 12 and will contact the ground when a wheel stand is performed. When in fifth gear, the center of gravity of toy vehicle 10 is moved back to 50% of its maximum since only one weight is pivoted to the rear. Toy vehicle 10, when driven by motor 20, will turn to the right as the front wheels are lifted and a wheel stand is performed.

In accordance with the above description of a toy vehicle constructed in accordance with the present invention, a multiaction toy vehicle which exhibits different physical behavior and operating characteristics depending upon the position in which the simulated gear shift lever is placed provides an enhanced play value to a regular motorized or propelled toy vehicle. The objects and advantages of the present invention are achieved through a construction as described above and such a toy vehicle is simple and relatively inexpensive to manufacture. it is noted that the objects and advantages may be obtained in the first embodiment even if a single movable weight is used.

FIG. 22 depicts an alternative embodiment of a weight 132 wherein projection 139 thereof includes a roller 140 which, when weight 132 is pivoted in the rearward direction, will contact and roll on surface 8. Roller 140 will reduce the running friction of projection 139 as it rolls along surface 8. It is noted that both weights in the toy vehicle may have such rollers.

As depicted in FIG. 24, one of the two pivotable weights can be heavier than the other to permit further variations between left and right turns of the toy vehicle. As depicted in FIG. 24, left side weight 138 is more massive and larger than right side weight 30.

FIG. 25 depicts another alternative embodiment of the present invention where a portion 40' of platform 40 contacts a gear 19 of motor 20 when shift lever 44 is in neutral position so that a braking action by means of friction on gear 19 can be provided.

Figure 26:
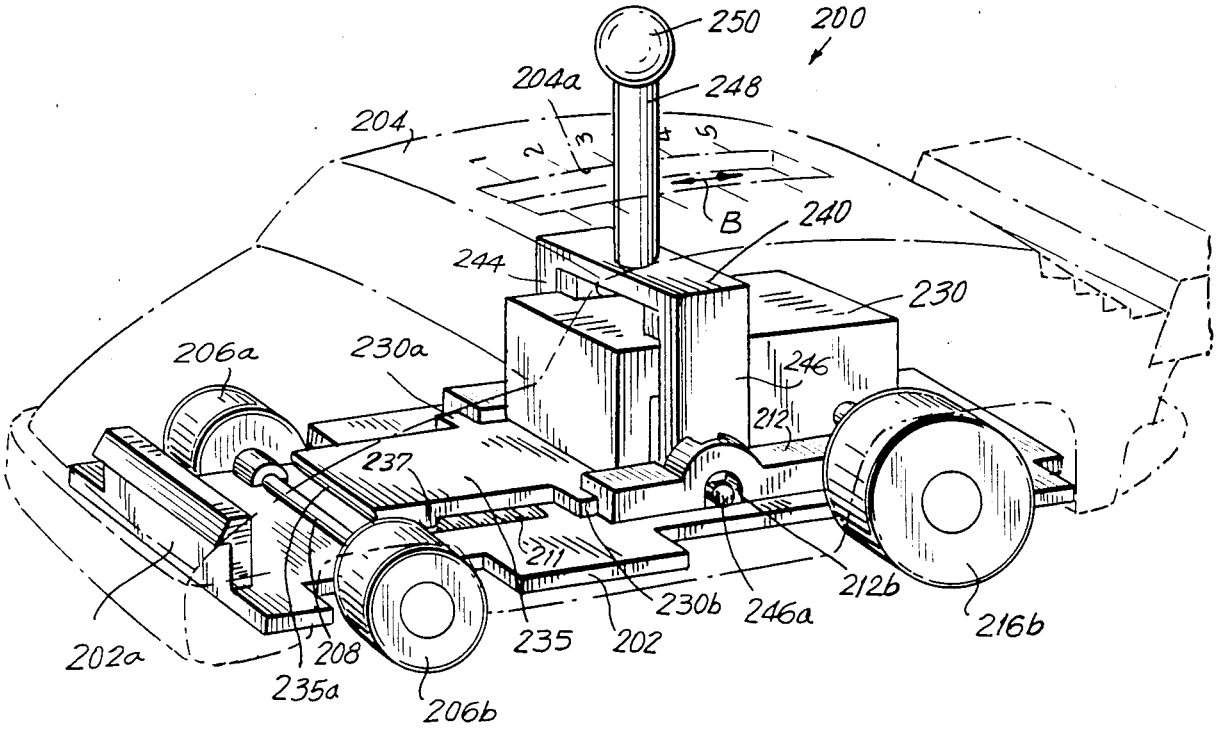
FIG. 26 is a perspective view of a toy vehicle constructed in accordance with a second embodiment of the present invention with the vehicle body shown in phantom.
Figure 27:
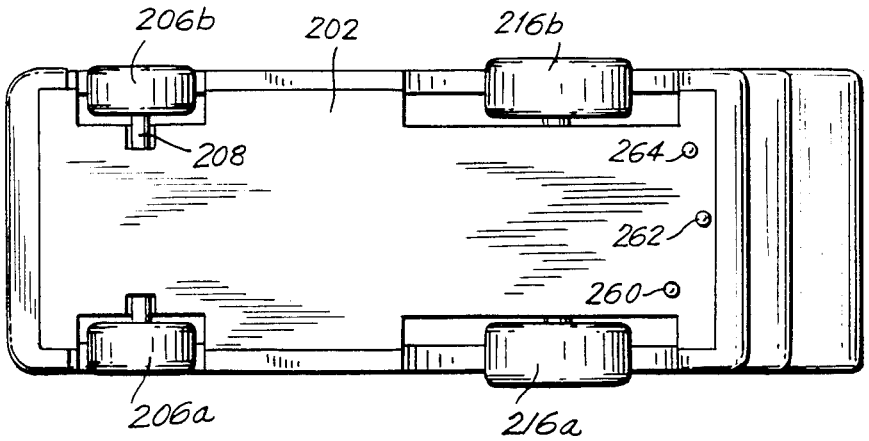
FIG. 27 is a bottom plan view of the toy vehicle depicted in FIG. 26.
Figure 28:
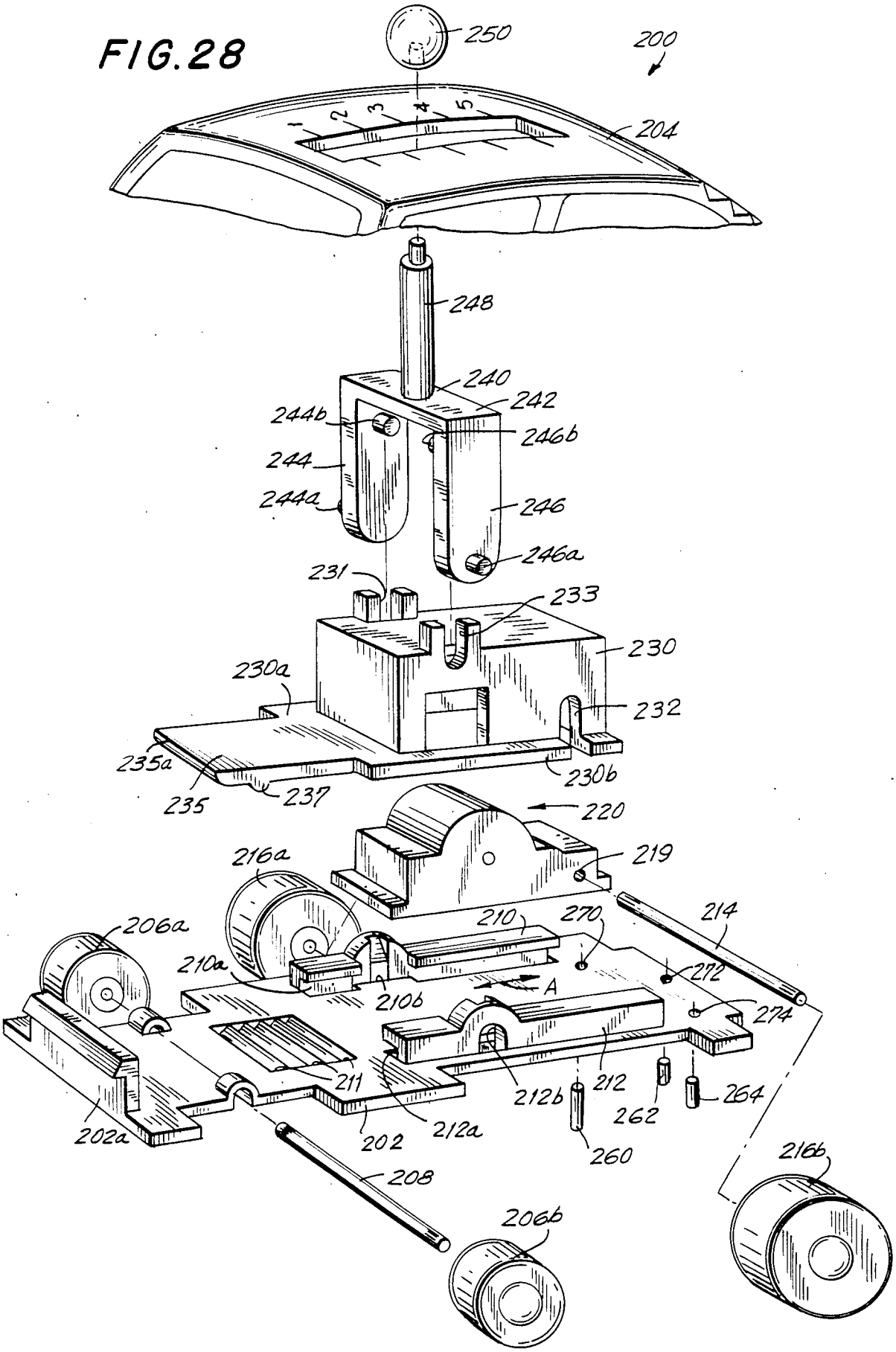
FIG. 28 is an exploded perspective view of the toy vehicle depicted in FIG. 26.

Reference is now made to FIGS. 26 through 28 which depict a toy vehicle, generally indicated at 200, constructed in accordance with another embodiment of the present invention. Toy vehicle 200 includes a chassis 202 which supports a toy vehicle body 204. A pair of front wheels 206*a* and 206*b* are rotatably supported on front end 202*a* of chassis 202 by means of an axle 208. Opposing side rails 210 and 212 are provided on opposing sides of chassis 202 on the upper surface thereof. An energy storing mechanism 220 such as a pull back motor or other wind-up motor or the like is slidably supported on chassis 202 between rails 210 and 212. An axle 214 extends through an opening 219 in motor 220 and is operatively coupled to motor 220 so as to be rotated thereby. A pair of rear wheels 216*a* and 216*b* are secured to opposite ends of axle 214. A sliding motor retainer cover 230 is positioned over motor 220 and includes slots 232 through which rear axle 214 may extend. Cover 230 is positioned over motor 220 and includes side wings 230*a* and 230*b* which are captured within cutouts 210*a* and 212*a* formed in rails 210 and 212, respectively. This permits cover 230 and motor 220 captured thereunder to be slidable on chassis 202 in the directions indicated by arrow A.

A shift lever mechanism 240 includes a U-shaped section 242 having downwardly extending arms 244 and 246 and a shift arm lever 248 which extends in an upward direction through slot 204*a* in car body 204. Pivot pins 244*a* and 246*a* on the outer surface of legs 244 and 246 are captured in openings 210*b* and 212*b* formed respectively in rails 210 and 212. Slide pins 244*b* and 246*b* on the inner surface of legs 244 and 246 ride in U-shaped slots 231 and 233, respectively, formed on sliding motor cover 230. A shift knob 250 is secured to the top of shift lever 248.

Three projections 260, 262 and 264 preferably of different lengths are secured in openings 270, 272 and 274 so as to extend from the underside of chassis 202. Motor cover 230 includes an extension 235 having a detent 237. Detent position recesses 211 are formed on the upper surface of chassis 202 so as to coact with detent 237 in order to hold motor cover 230 in a desired position. By moving shift lever 248 along slot 204*a* formed in vehicle body 204 in the directions of arrow B, the wheel base, that is, the distance between the front wheels and rear wheels, can be changed to alter the balance of the vehicle, its center of gravity and the vehicle's running stability.

Reference is now made additionally to FIGS. 29 through 33 for explaining the operation and use of toy vehicle 200.

Figure 29:
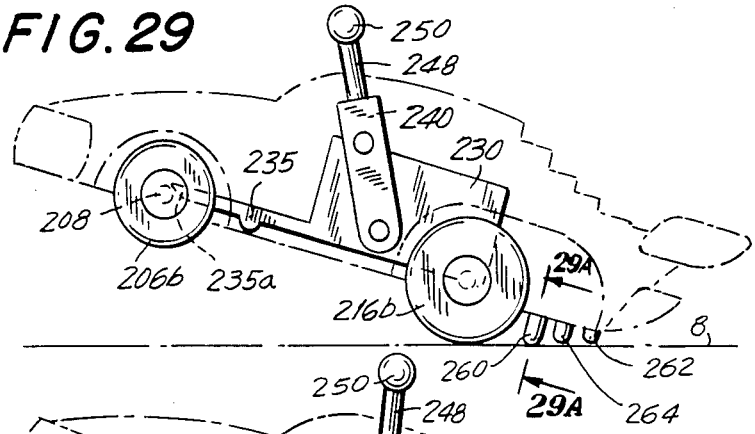
FIGS. 29, 30, 31, 32 and 33 are side elevational views of the toy vehicle depicted in FIG. 26 shown with the lever in different gear positions for explaining the operation of the toy vehicle depicted in FIG. 26.
Figure 29A:
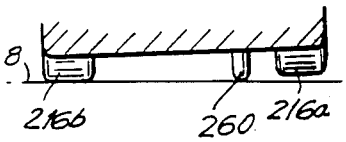
FIGS. 29A, 30A and 31A are associated respectively with FIGS. 29, 30 and 31 and are sectional views thereof and depict the rear wheels and projections of the toy vehicle depicted in FIG. 26.

When shift lever 248 is in its forward-most position in the first gear position as depicted in FIGS. 29 and 29A, the rear wheels will be moved to their forward-most position thereby producing the shortest wheel base. The front end 235*a* of extension 235 presses against front axle 208 so as to apply a force thereagainst. Rear wheels 216*a* and 216*b* will be forward of all three projections 260, 262 and 264. As motor 220 drives vehicle 200 in a forward direction, the toy vehicle will perform a wheel stand as depicted in FIG. 29. When a wheel stand is performed, the longest projection 260 will contact ground 8. When projection 260 contacts the ground during a wheel stand, right rear wheel 216 will be lifted off the ground causing the left rear wheel 216*b* to power the vehicle in a spin to the right. Surface 235*a* pressing against the front axle will cause a breaking action when front wheels 206*a* and 206*b* are attempting to roll on the ground.

Figure 30:
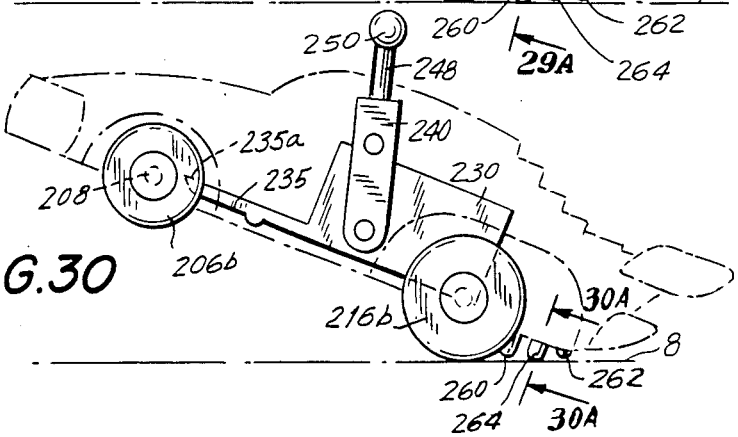
Figure 30A:
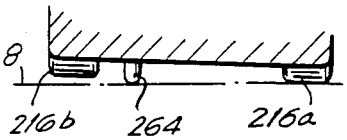

FIGS. 30 and 30A depict toy vehicle 200 with shift lever 248 in the second gear position. Front surface 235*a* of extension 235 is released from engagement with front axle 208. Detent 237 engages in a second detent position recess 211. The wheel base is lenghtened slightly so that the longest projection 260 is positioned slightly behind the rear wheels. As motor 230 drives vehicle 200 in a forward direction and a wheel stand is performed, projection 260 will move up and away from the ground and left projection 264 will contact the ground thereby lifting left rear wheel 216*b*. This causes right rear wheel 216*a* to power the vehicle in a spin or turn to the left.

Figure 31:
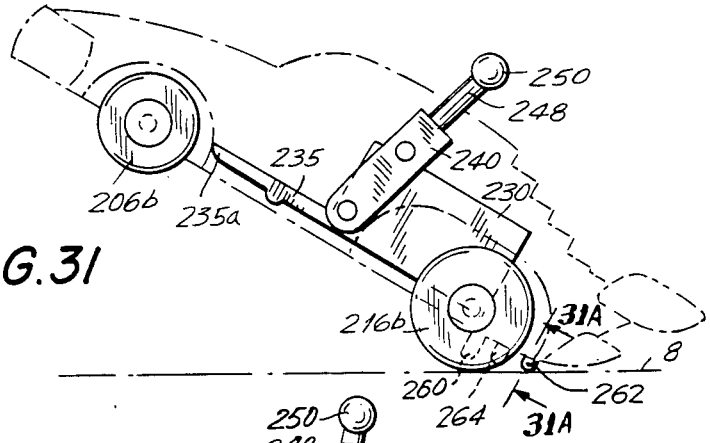
Figure 31A:
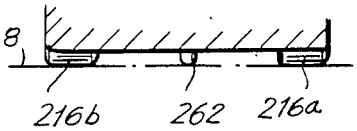

FIGS. 31 and 31A depict toy vehicle 200 with shift lever 248 in the third gear position. In this third gear position, the rear wheels are moved further back thereby lengthening the wheel base and moving left projection 264 behind the rear wheels. Accordingly, during a wheel stand as vehicle 200 is powered forward, projections 260 and 264 will move upward and the shortest center projection 262 will contact the ground. This action aids toy vehicle 200 in running straight during the wheel stand since projection 262 is centrally located.

Figure 32:
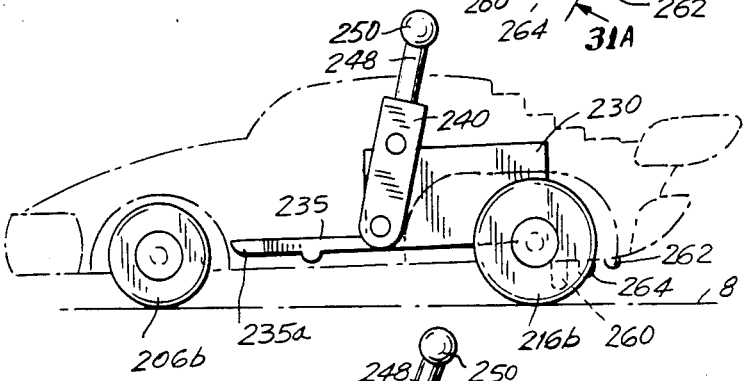

FIG. 32 depicts toy vehicle 200 when shift lever 248 is in the fourth gear position. In the fourth gear position, the rear wheels are moved back a sufficient difference to create a relatively stable wheel base for the toy vehicle. There is generally sufficient weight in front of the rear axle to prevent the toy vehicle from performing a wheel stand while moving forward. However, in an alternative embodiment, the front wheels may be elliptical in shape which would cause the front end to be raised when in fourth gear since the front end of the vehicle would be thrown upward by the rotating elliptical wheels.

Figure 33:
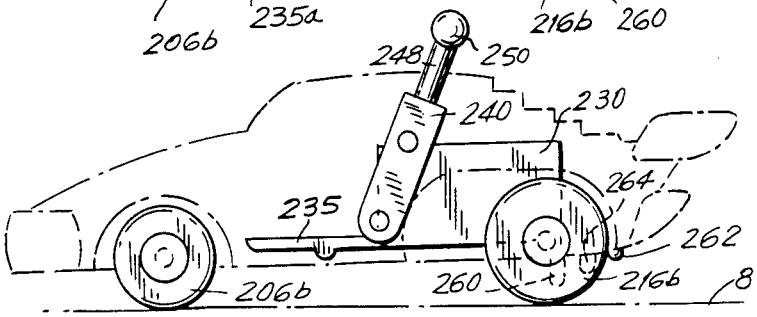

FIG. 33 depicts toy vehicle 200 when in a fifth gear position. The distance between the front and rear wheels is greatest in the fifth gear position so that the wheel base is longest. A stable ride without wheel stands will be performed by the toy vehicle.

The present embodiment under discussion like the preferred embodiment depicted in FIGS. 1 through 3 provides a multiaction toy vehicle in which the physical behavior and operating characteristics of the toy vehicle can be determined by the child by setting a simulated gear shift lever in a desired gear position. Whereas the first embodiment utilizes pivoting weights to change the center of gravity of the toy vehicle, the present embodiment utilizes a change in the wheel base to alter the physical behavior and center of gravity of the toy vehicle. Such multi-action toy vehicles as those described in detail herein provide a toy having a high level of play value to children.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A toy vehicle comprising a chassis, wheel means rotatably supported on said chassis for permitting said chassis to roll on a surface, changing means supported on said chassis for changing the center of gravity of said toy vehicle and control means operatively coupled to said changing means for selectively controlling said changing means in responce to manual manipulation thereof, said changing means including weight means movably supported on said chassis, said control means selectively adjusting said weight means to adjust the center of gravity of said toy vehicle, said control means being a lever means coupled to said weight means for selectively positioning said weight means on said chassis, said chassis including a front end and a rear end, said wheel means including at least a first front wheel rotatably supported on said front end of said chassis and first and second rear wheels rotatably supported on the rear end of said chassis, said weight means being supported on said chassis proximate said first and second rear wheels, said weight means including a first weight pivotally supported on said chassis proximate said first rear wheel and a seond weight pivotally supported on said chassis proximate said second rear wheel, said lever means being operatively coupleable to said first and second weights to selectively pivot said first and second weights whereby the center of gravity of said toy vehicle is changed.

2. The toy vehicle as claimed in claim 1, further comprising motor means supported on said chassis and operatively coupled to said first and second rear wheels for powering said toy vehicle.

3. The toy vehicle as claimed in claim 2, whereins aid motor means is a pull-back motor which is tightened when said first and second rear wheels are rolled in a reverse direction over said surface, said pull-back motor driving said rear wheels in a forward direction when said toy vehicle is released.

4. The toy vehicle as claimed in claim 3, wherein said lever means simulates a gear shift lever.

5. The toy vehicle as claimed in claim 4, wherein said chassis includes a toy car body attached thereto, said toy car body having a slot formed therein in the shape of a gear shift pattern, said lever means extending through said slot.

6. The toy vehicle as claimed in claim 5, wherein said slot defines a plurality of gear shift positions, said lever means being manually movable between said gear shift positions to set said lever means in a selected one of said positions, each said gear shift position corresponding to a position of said first and second weights as controlled by said lever means.

7. The toy vehicle as claimed in claim 1, further comprising motor means coupled to said wheel means for rotating said wheel means, said lever means simulating a gear shift lever.

8. The toy vehicle as claimed in claim 1, wherein said first weight is heavier than said second weight.

9. The toy vehicle as claimed in claim 6, wherein said lever means contacts said motor means when said lever means is in a selected one of said gear shift positions to provide a continuous braking drag at said one position.

10. A toy vehicle comprising a toy vehicle frame, a pair of front wheels rotatably supported on said frame, a pair or rear wheels rotatably supported on said frame, first and second weights movably supported on said frame proximate said pair of rear wheels, a lever operatively coupleable to said first and second weights for selectively positioning said weights in preselected orientations with respect to said frame, a toy vehicle body coupled to said frame and having a slot through which said lever extends for manipulation, and motor means for rotating said rear wheels to drive said vehicle in a forward direction.

* * * * *